United States Patent [19]

Wilkes

[11] Patent Number: 5,069,781

[45] Date of Patent: Dec. 3, 1991

[54] COMBINED FLOOR SINK AND STRAINER

[76] Inventor: Gene W. Wilkes, 20910 Peachtree Rd., Dickerson, Md. 20842

[21] Appl. No.: 521,407

[22] Filed: May 10, 1990

[51] Int. Cl.[5] ..... F03C 1/26

[52] U.S. Cl. ..... 210/164; 4/290; 4/292

[58] Field of Search ..... 4/290, 286, 291, 292; 210/164, 163, 165, 166

[56] References Cited

U.S. PATENT DOCUMENTS

| | | | |
|---|---|---|---|
| 316,925 | 4/1885 | Vogel . | |
| 557,075 | 3/1896 | Langer . | |
| 586,709 | 7/1897 | Kunzel . | |
| 1,798,441 | 1/1929 | Weiss . | |
| 4,321,713 | 3/1982 | Thompson | 4/290 |

*Primary Examiner*—Frank Sever
*Attorney, Agent, or Firm*—Michael W. York

[57] ABSTRACT

A combined floor sink and strainer for removing solid particles contained in the fluid passing through it. The combined floor sink and strainer has a hollow substantially rectangular housing, a strainer basket for holding the solid particles or sediment removed from the fluid passing through the combined floor sink and strainer and a locating and support structure for locating and supporting the strainer basket within the housing. The support structure and strainer basket have perforations to permit the passage of liquid but prevent the passage of solid particles over a particular particle size. The housing has a removable lid with three inlets and an outlet in its lower portion and a locating and support flange surrounds the upper portion of the housing the permit the housing to be removably located in the floor. The construction of the strainer basket and the strainer basket locating and support structure is such that three different paths are provided depending upon the amount of the debris collected in the strainer basket and this prevents a reduction in fluid flow as the sediment builds up in the sediment basket.

10 Claims, 1 Drawing Sheet

COMBINED FLOOR SINK AND STRAINER

BACKGROUND OF THE INVENTION

Floor sinks have been in use for many years. In many cases floor sinks are highly useful for collecting waste water and the like that is drained off of floors and the like. Floor sinks can also be very useful for draining off the waste water from a wide variety of facilities and devices such as dishwashers and laundry machines. Since floor sinks are located in the floor usually gravity is relied upon to deliver the waste water and the like that is to be received by the floor sink and this feature makes floor sinks highly useful.

Unfortunately, the waste water and the like that floor sinks collect usually contains solid particles of food or other debris that is only temporarily suspended in the waste water. Such solid particles can easily lodge in the floor sink or even worse and possible more likely in the adjacent plumbing or sewer system and this will usually result in blockage of the sewer system or the like or the floor sink over time. This blockage will result in the waste water or the like being prevented from running through the sewer system and hence the waste water will back up and cause flooding of the adjacent floor with waste water which is not only unsanitary but can also result in physical damage to articles that might be located where they can come into contact with the backed up waste water.

To get rid of such backed up waste water it is usually necessary to pump the waste water out and then remove the blockage of food particles or the like. The removal of the blockage most likely will require the use of plumbing tools such as an elongated flexible member that can be rotated such as that commonly referred to as a "snake". In severe cases the floor may have to be taken up and the sewage lines dug up so that the blocked portion can be cleaned out or replaced. Such procedures are very time consuming and are very expensive and obviously it would be highly desirable to avoid these.

Various types of screens and the like have been used in the past to filter out suspended solid particles, but such screens have been used primarily in connection with particular types of equipment or appliances such as dishwashers and the like. In situations where there are numerous appliances, this means that there would be a number of screens that would have to be periodically inspected and cleaned or replaced which is inconvenient and time consuming. In addition, some appliances have no such screens of the like and hence suspended solids will pass into the sewer system and hence possibly cause a blockage of the system. The screens also become clogged in use and this has the undesirable effect of causing the backing up of waste water or possibly flooding and/or damage to appliances or equipment.

In view of the foregoing a need exists for an effective strainer and floor sink combination that has provisions for avoiding blocking of the sink. The present combined floor sink and strainer invention overcomes these previous problems and provides an effective strainer system located in the floor sink that is designed to allow fluid to pass through it even when the strainer is filled with sediment. This is accomplished by providing an alternative fluid flow path when the strainer becomes filled with sediment. In addition, provision is made for quickly removing a clogged strainer and replacing it with a clean strainer without shutting the combined floor sink and strainer down. The removed strainer can be readily cleaned separate from the combined floor sink and strainer. The combined floor sink and strainer is constructed in a manner that the reduction in flow rate when it is in use is kept to a minimum.

SUMMARY OF THE INVENTION

This invention relates to floor sinks and more particularly to a floor sink that includes a strainer.

Accordingly, it is an object of the invention to provide a combined floor sink and strainer that is very efficient.

It is an object of the invention to provide a combined floor sink and strainer that is capable of handling a high flow rate.

It is an object of the invention to provide a combined floor sink and strainer that is capable of handling a large amount of sediment.

It is an object of the invention to provide a combined floor sink and strainer that is not subject to backing up.

It is an object of the invention to provide a combined floor sink and strainer that has three liquid flow paths.

It is an object of the invention to provide a combined floor sink and strainer that has three flow paths with a primary flow path when the strainer is not filled with sediment.

It is an object of the invention to provide a combined floor sink and strainer that has three liquid flow paths with a primary alternative flow path when its strainer is partially filled with sediment.

It is an object of the invention to provide a combined floor sink and strainer that has three liquid flow paths with a primary alternative flow path when its strainer is completely filled with sediment.

It is also an object of the invention to provide a combined floor sink and strainer that causes no significant impediment to the fluid flowing through it.

It is an object of the invention to provide a combined floor sink and strainer that uses a perforated interior construction that does not impede the liquid flowing through it.

It is an object of the invention to provide a combined floor sink and strainer in which the strainer is easily accessible.

It is an object of the invention to provide a combined floor sink and strainer that has easy access to its interior.

It is an object of the invention to provide a combined floor sink and strainer that has an easily removable cover.

It is an object of the invention to provide a combined floor sink and strainer in which the strainer can be easily cleaned.

It is an object of the invention to provide a combined floor sink and strainer in which the strainer is removable for easy cleaning.

It is an object of the invention to provide a combined floor sink and strainer that requires little or no interruption in its use when the strainer is serviced.

It is an object of the invention to provide a combined floor sink and strainer that has a second strainer.

It is an object of the invention to provide a combined floor sink and strainer with provisions for easy manual removal of the strainer.

It is an object of the invention to provide a combined floor sink and strainer with a pair of handles associated with the strainer to assist in the manual removal of the strainer.

It is an object of the invention to provide a combined floor sink and strainer that is easy to install.

It is an object of the invention to provide a combined floor sink and strainer that is easy to remove after it has been installed.

It is an object of the invention to provide a combined floor sink and strainer that has an installation lip for locating and supporting the combined floor sink and strainer in its proper position in a floor.

It is an object of the invention to provide a combined floor sink and strainer in which the installation lip can also assist in the removal of the combined floor sink and strainer after it has been installed.

It is an object of the invention to provide a combined floor sink and strainer that can receive the output from a plurality of appliances and the like.

It is an object of the invention to provide a combined floor sink and strainer that has a plurality of inlets.

It is an object of the invention to provide a combined floor sink and strainer with a plurality of sized inlets.

It is an object of the invention to provide a combined floor sink and strainer that needs no maintenance or repair.

It is an object of the invention to provide a combined floor sink and strainer that is constructed of a corrosive proof material.

It is an object of the invention to provide a combined floor sink and strainer that is constructed essentially of stainless steel.

These and other objects are obtained through the combined floor sink and strainer invention that includes a hollow housing with an outlet in its lower portion and with a removable lid that has at least one inlet in its upper portion, a strainer basket sized and shaped to be removably located within the hollow housing and a strainer basket locating and a support structure for removably locating and supporting the strainer basket within the hollow housing. The construction of the strainer basket and the strainer basket locating and support structure is such that multiple liquid flow paths are provided with the path being used depending upon the amount of sediment in the strainer basket. This avoids a reduction in liquid flow rate due to sediment buildup.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figure 1:
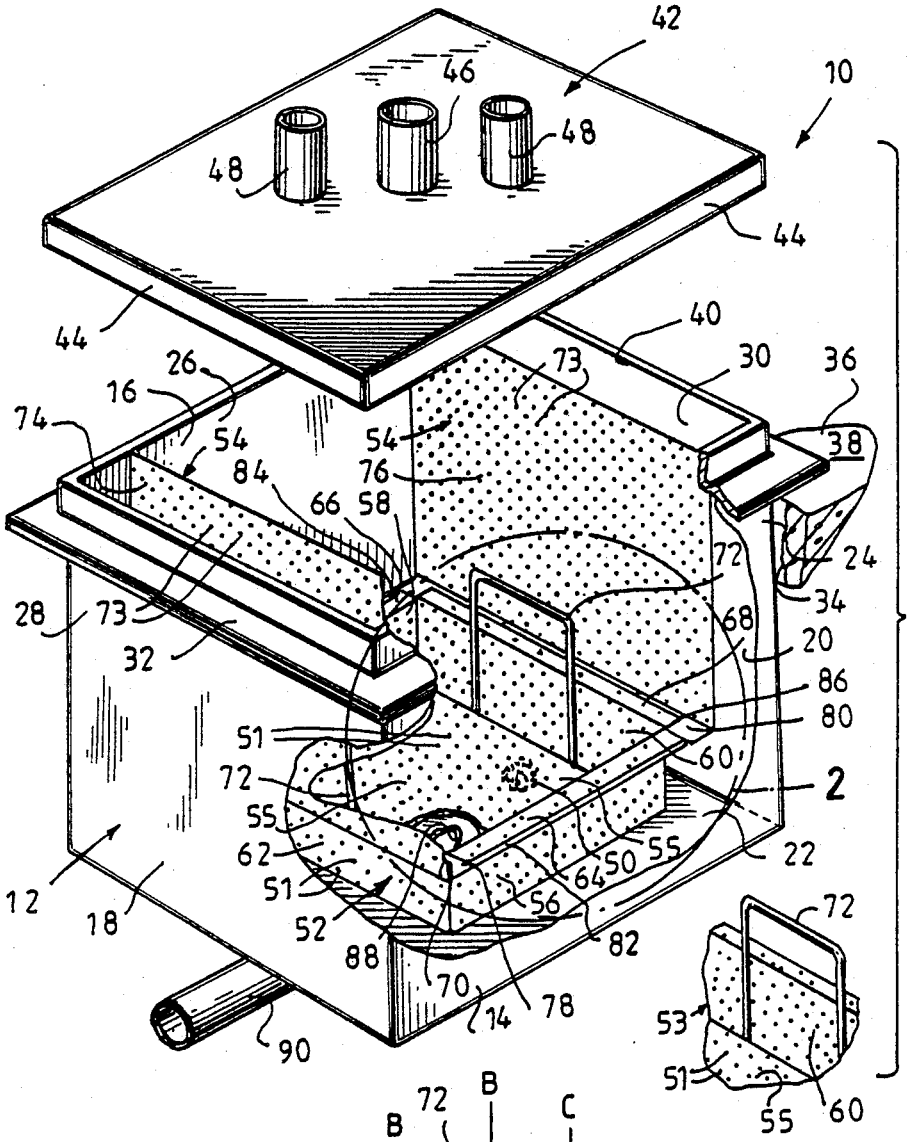
FIG. 1 is a perspective of the combined floor sink and strainer with certain portions broken away and its cover removed for clarity.

Referring first to FIG. 1, the combined floor sink and strainer invention is illustrated and is designated generally by the number 10. The combined floor sink and strainer 10 comprises a generally rectangular shaped hollow housing 12 with substantially flat rectangular shaped and substantially identical oppositely located forward and back side walls 14 and 16 and smaller substantially rectangular shaped and substantially identical oppositely located end walls 18 and 20 that extend upward from and whose lower edges are connected to a substantially flat rectangular shaped bottom portion 22. The upper portions 24, 26, 28 and 30 of the respective side walls 14, 16, 18 and 20 have a substantially flat outward extending narrow mounting flange 32 connected to them. The flange 32 is sized, shaped and located to support the combined floor sink and strainer 10 in a suitably sized and shaped hole 34 in a floor 36 in such a manner that the lower surface of the flange rests on the upper surface 38 of the floor 36.

As also illustrated in FIG. 1, the hollow housing 12 has a substantially rectangular shaped opening 40 adjacent to and formed by the upper portions 24, 26, 28 and 30 of the respective side walls 14, 16, 18 and 20. A substantially rectangular shaped lid 42 is provided that is sized, shaped and adapted to fit over the opening 40 in the housing 12. This lid 42 has a downward depending lip portion 44 that is sized and shaped to fit around the upper portions 24, 26, 28 and 30 of the side walls 14, 16, 18 and 20. A large hollow inlet conduit 46 extends through and is connected to the center portion of the lid 42 and two smaller substantially identical hollow inlet conduits 48 are located on each side of the larger hollow inlet conduit 46 and extend through and are connected to the lid 42. One or more of these conduits 46 and 48 are used to pass fluid into the housing 12 of the combined floor sink and strainer 10.

Straining means for straining sediment from liquid flowing through the housing 12 is located within the housing 12 and comprises a substantially rectangular shaped strainer basket 52 and strainer basket locating and support means designated by the number 54 for locating and supporting the strainer basket 52 within the housing 12 so that the strainer basket 52 is located above and away from the bottom portion 22 and the side walls 14, 16, 18 and 20 of the housing 12.

The basket 52 has a substantially rectangular shaped flat bottom portion 55, oppositely located forward and back substantially identical walls 56 and 58 and oppositely located side walls 60 and 62 that are all connected to and extend upward from the bottom portion 55. The upper portion of each side wall 56, 58, 60 and 62 has respective substantially identical outward projecting substantially rectangular shaped lips 64, 66, 68 and 70. An inverted U-shaped member has its projecting legs fastened to the wall 60 to form a handle 72 and a substantially identical handle 72 is connected in a similar manner to the opposite wall 62. As illustrated, the entire strainer basket 52 except the handles 72 is perforated even including the lips 64, 66, 68 and 70. A second strainer basket 53 (only part of which is shown) is also provided that is substantially identical to the basket 52.

As illustrated in FIG. 1 the strainer basket locating and support means 54 comprises two substantially identical vertically oriented substantially flat perforated support members 74 and 76 that have inward projecting respective substantially flat substantially rectangular flanges 78 and 80. These flanges 78 and 80 are interconnected by substantially flat substantially rectangular shaped horizontal support members 82 and 84 that are connected to the undersides of and interconnect the outer portions of the flanges 78 and 80. The flanges 78 and 80 and the connected horizontal support members 82 and 84 form a substantially rectangular shaped aperture 86 that is sized and shaped to receive the strainer basket 52 in such a manner that the lips 64, 66, 68 and 70 rest against the flanges 78 and 80 and the support members 82 and 84 so as to support the strainer basket 52 in its in use position in the aperture 86.

As also illustrated in FIG. 1, the vertical support members 74 and 76 extend completely across the interior of the housing 12 from the interior surface of the side wall 14 to the interior surface of the oppositely located side wall 16. In addition, the horizontal support members 82 and 84 abut up against the respective side walls 14 and 16. Consequently, the incoming fluid coming through one of the inlet conduits 46 or 48 cannot go around the vertical support members 74 and 76, the connected horizontal support members 82 and 84 and the strainer basket 52 when it is in place. Consequently, fluid must pass through the perforations 51 in the strainer basket 52, the perforations 73 in the support members 74 and 76 and/or the horizontal support members 82 and 84 and hence dirt and debris sediment 50 and the like cannot pass if its particle size is larger than the size of the perforations 52 and 73. This means that dirt or debris 50 that is larger than this perforation size cannot leave with the liquid that leaves the housing 12 through the exit fluid conduit 88 that is located in the center portion of the bottom 22 of the housing and is connected to a conventional sewer conduit 90 or the like.

Figure 2:
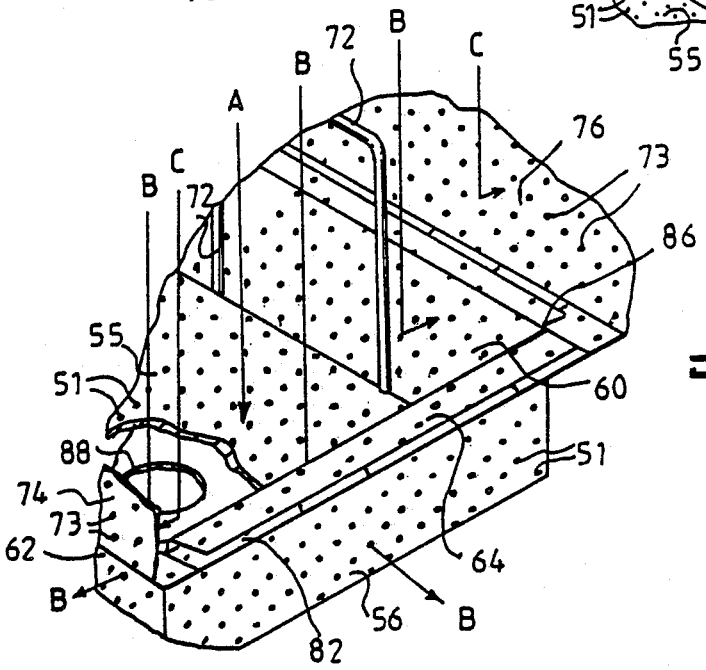
FIG. 2 is an enlargement of a portion of the structure illustrated in FIG. 1 taken within the circle 2 thereof.

As illustrated in FIG. 2, three primary liquid flow paths are provided in the interior of the hollow housing 12 for liquid that flows from one of the inlet conduits 46 or 48 to the outlet conduit 88. These three important primary flow paths are designated by the letters A, B, and C and the associated arrows that illustrate the direction of fluid flow. These three flow paths are made possible by the fact that not only is the bottom portion 55 of the strainer basket 52 perforated but also its sides 56, 58, 60 and 62 as well as the support members 74 and 76.

Normally, when the bottom portion 55 and its perforations are not completely covered with debris or sediment 50, the primary liquid flow path is illustrated by the letter A and its arrow and passes through the perforated bottom portion 55. With time and the passage of debris laden fluid through the housing 12, the bottom portion 55 and its perforations 51 will become covered with sediment 50 and liquid cannot pass through the bottom portion 55 and hence cannot follow the liquid flow path designated A. Instead, the primary liquid flow path becomes the liquid flow path designated by the letter B and the associated arrows which is the flow path that goes through at least one of the sides 56, 58, 60 and 62 of the strainer basket 52. However, with the continuing passage of debris laden fluid even the sides 56, 58, 60 and 62 and their perforations 51 will also become covered with debris or sediment 50 so that liquid cannot pass through them. When this occurs, the primary liquid flow path becomes the liquid flow path through the support members 74 and 76 designated by the letter C and the associated arrows pointing through the support members 74 and 76. In view of this arrangement the flow rate of liquid is not significantly decreased as the liquid flows through the housing 12 even when the strainer basket 52 is completely filled with sediment 50.

The combined floor sink and strainer 10 is made in the following manner. The hollow housing 12 including its lid 42 and projecting flange 42 is constructed from number 16 gauge stainless steel using suitable standard cutting, bending and welding techniques known in the art. The inlet conduits 46 and 48 and the outlet conduit 88 are cut and suitably welded to the housing 12 also using conventional techniques. The strainer basket 52, except the handles 72, and the various support members 74, 76, 82 and 84 are made from number 304 16 gauge perforated stainless steel with a hole size of $\frac{1}{8}$ of an inch or smaller and 32 holes per square inch or more through conventional cutting, bending and welding techniques known in the art and the support members are suitably welded together inside the housing 12 using known techniques. The handles 72 that are made from stainless steel are also conventionally welded to the forward and back walls 56 and 58 of the strainer basket 52.

The combined floor sink and strainer 10 is used in the following manner. Unless there is a previously made hole in the floor 36 a hole 34 of suitable size to removably receive the housing 12 is made in the floor 36 in the vicinity of the sewer conduit 90. Provision is made in a conventional manner for connecting the outlet conduit 88 to the sewer conduit 90 and the housing 12 is inserted into the hole 34 so that the flange 42 rests upon the upper surface 38 of the floor 36. One of the strainer baskets 52 is then inserted into the hole 86 that is sized and shaped to receive one of the baskets 52. The lid 42 is then placed on the housing 12 and inlet liquid is sent into one or more of the inlet conduits 46 or 48 through suitable conduits (not shown).

As liquid passes through one or more of the conduits 46 or 48 it passes into the interior of the housing 12 and at least initially with an empty strainer basket 52 it primarily follows the liquid flow path designated by the arrow and letter A in FIG. 2 and hence the liquid primarily passes through the perforations 51 in the flat bottom portion 55 of the strainer basket 52. Then when dirt or debris 50 covers the bottom portion 55 and its perforations 51, the primary liquid flow path is changed to that represented by the arrow and associated letter B and hence the liquid primarily passes through the perforations 51 in the side walls 56, 58, 60 and 62 as represented by the side wall 60 of the basket 52. When the primary liquid flow paths are those represented by the arrows and the associated letters A and B, liquid passes through the perforations 51 in the respective bottom portion 55 and the side walls 56, 58, 60 and 62 of the basket 52 and hence any dirt or debris 50 is still retained in the basket 52.

However, when the basket 52 is full of debris 50, the liquid flow path can no longer be that represented by the arrows and letters A and B since all the holes or perforations 51 in the basket 52 will be covered by dirt or debris 50. When this occurs, liquid will still flow and there will not be a back up which is the case with conventional straining systems. Instead, liquid flows in the direction represented by the arrows and the associated letters C which is in a direction through the perforations 73 in the support members 74 and 76. Consequently, there is no liquid back up even though the basket 52 is full of debris or dirt 50.

When the basket 52 is full of debris 50, the cover or lid 42 is removed and then the basket 52 is removed through the use of the handles 72. The second or replacement basket 53, that is substantially identical to the basket 52, is then inserted into the hole 86. This permits the debris 50 laden basket 52 to be removed and cleaned without interrupting the straining of the liquid flowing through the combined floor sink and strainer 10 for any substantial period of time.

The excellent flow and straining characteristics of the invention also result from the fact that there are liquid flow paths through at least seven perforated surfaces in the combined floor sink and strainer invention 10. Five of these flow paths are through the perforated sides 56, 58, 60, and 62 and the bottom 55 of the basket 52. All of these flow paths are available since the basket 52 is suspended away from the walls 14, 16, 18, and 20 and the bottom 22 of the housing 12. Two other liquid flow paths are through the perforated support members 74 and 76. Other minor liquid flow paths are through the perforated flanges 78, 80, the support members 82 and 84 and the related perforated lips 64, 66, 68 and 70 of the basket 52.

Although the invention has been described in considerable detail with reference to a certain preferred embodiment, it will be understood that variations and modifications may be made within the spirit and scope of the invention as defined in the appended claims.

What is claimed is:

1. A floor sink for use in a floor comprising: a hollow floor sink housing having a bottom and side walls, at least one liquid inlet and a liquid outlet located to provide for the entrance of liquid into and the exit of liquid out of said hollow floor sink housing; strainer means for straining solid particles from liquid passing through said floor sink comprising a strainer basket; and strainer basket locating and holding means located within said hollow floor sink housing for locating and holding said strainer basket within said hollow floor sink housing, said strainer basket locating and holding means for locating and holding said strainer basket comprising means for locating said strainer basket away from the bottom and side walls of said hollow floor sink housing and further comprising means for forming a barrier to the passage of solid particles and for permitting passage of liquid positioned within said hollow floor sink housing to prevent incoming liquid coming through said inlet from going around said means for forming a barrier to the passage of solid particles and for permitting passage of liquid and said strainer basket when said strainer basket is located in place within said hollow floor sink housing by said strainer basket locating and holding means.

2. The floor sink of claim 1 wherein the means for forming a barrier of said strainer basket locating and holding means comprises vertically oriented perforated support members located between at least two side walls of said floor sink housing.

3. The floor sink of claim 2 wherein the means for forming a barrier of said strainer basket locating and holding means also comprises perforated horizontal support members located between at least two side walls of said floor sink housing.

4. The floor sink of claim 3 wherein said strainer basket has a portion with lips and wherein at least a portion of said perforated horizontal support members are sized and shaped to receive the lips of said strainer basket.

5. The floor sink of claim 4 wherein the lips of said strainer basket are perforated whereby liquid can pass through said perforated lips and the associated perforated horizontal support member portions.

6. The floor sink of claim 5 wherein said floor has an upper surface and wherein said hollow floor sink housing has an upper end portion and wherein said upper end portion has at least a portion thereof adapted to be located above the upper surface of said floor.

7. The floor sink of claim 6 further comprising a removable lid sized and shaped to fit around the upper end portion of said hollow floor sink housing.

8. The floor sink of claim 7 wherein said strainer basket is removable and further comprising a second strainer basket for use as a replacement for the other strainer basket.

9. The floor sink of claim 7 wherein said strainer basket has at least one handle.

10. The floor sink of claim 9 wherein the entire strainer basket except said handle is perforated.

* * * * *